US008487817B2

(12) United States Patent
Roddy et al.

(10) Patent No.: US 8,487,817 B2
(45) Date of Patent: Jul. 16, 2013

(54) RF ANTENNA END PANEL

(75) Inventors: Timothy S. Roddy, Plymouth, MI (US); Mark P. Zachos, West Bloomfield, MI (US)

(73) Assignee: Dearborn Group, Inc., Farmington Hills, MI (US)

( * ) Notice: Subject to any disclaimer, the term of this patent is extended or adjusted under 35 U.S.C. 154(b) by 576 days.

(21) Appl. No.: 12/660,389

(22) Filed: Feb. 25, 2010

(65) Prior Publication Data

US 2011/0187605 A1 Aug. 4, 2011

Related U.S. Application Data

(60) Provisional application No. 61/208,766, filed on Feb. 27, 2009.

(51) Int. Cl.
*H01Q 1/24* (2006.01)

(52) U.S. Cl.
USPC ..... 343/702

(58) Field of Classification Search
USPC ..... 343/702, 895, 829–841
See application file for complete search history.

(56) References Cited

U.S. PATENT DOCUMENTS

| | | | | |
|---|---|---|---|---|
| 4,740,794 | A * | 4/1988 | Phillips et al. | 343/702 |
| 5,541,398 | A * | 7/1996 | Hanson | 235/462.46 |
| 5,841,403 | A * | 11/1998 | West | 343/702 |
| 6,424,300 | B1 * | 7/2002 | Sanford et al. | 343/702 |
| 6,459,916 | B1 * | 10/2002 | Suguro | 455/575.7 |
| 6,470,174 | B1 * | 10/2002 | Schefte et al. | 455/90.1 |
| 6,618,013 | B1 * | 9/2003 | Aldous | 343/702 |
| 7,443,343 | B2 * | 10/2008 | Schlegel et al. | 343/700 MS |
| 2006/0250311 | A1 * | 11/2006 | Bishop | 343/702 |

* cited by examiner

*Primary Examiner* — Huedung Mancuso
(74) *Attorney, Agent, or Firm* — Warn Partners, P.C.

(57) ABSTRACT

The present invention is an endplate formed as part of a device used for transmitting or receiving a signal. The endplate has an inner plate, an outer plate operable for being connected to the inner plate, and an antenna mounted to the inner plate. The antenna is operable for connection with a device, such as a protocol adapter, which transmits and receives a signal. The endplate is operable for providing a ground plane relationship between the endplate and the antenna. The ground plane relationship between the endplate and the antenna is accomplished through the use of one of either the inner plate our outer plate being made of metal.

24 Claims, 4 Drawing Sheets

RF ANTENNA END PANEL

This application claims priority to U.S. Provisional Patent Application No. 61/208,766 filed on Feb. 27, 2009.

FIELD OF THE INVENTION

The present invention relates to an endplate for a communications device upon which a radio frequency (RF) antenna is mounted to protect the RF antenna from becoming damaged.

BACKGROUND OF THE INVENTION

Radio frequency (RF) antennas are generally known. One of the most common types of antennas is referred to as a "whip antenna." These types of antennas are commonly used for radios, televisions, wireless routers, and the like. Whip antennas are typically a long, substantially rigid but flexible wire. They can be in the form of a telescoping rod, or a helical coil. Whip antennas are most commonly made of copper wire, but can be made of other materials as well.

One particular type of application in which a whip antenna is also used is a device to communicate with a motor vehicle electronic control unit (ECU), or provide communications between a computer and a motor vehicle ECU. This device is often referred to as an "adapter," or "protocol adapter," which allows a host (such as a computer) to interface to one (or more) networks.

There can be multiple networks used by a motor vehicle or on an engineering test bench, and the adapter is operable to connect to them separately. These networks each have a "protocol," but the protocol may not be the same on each network (either electrically, or in terms of how communication messages are used). On each network there is a plurality of nodes, also referred to ECUs (Electronic Control Modules), which the adapter is able to communicate with directly. The protocol adapter enables a host (PC and software) to establish communications to a plurality of ECUs on a network using a specific "protocol." The adapter also establishes simultaneous communication using a separate physical connection to another network and communicates to a plurality of ECUs on that network using a specific "protocol."

Protocol adapters are often used in an environment in which the protocol adapter is exposed to various conditions which can cause damage to the whip antenna. During the developmental stages of engineering and designing a motor vehicle, the motor vehicle is tested in environments where the vehicle is exposed to extreme heat, cold, weather, and the like. The protocol adapter is often exposed to these environments as well. Although whip antennas are typically of a substantially rigid nature, exposure to these environments can cause damage to the antenna, where the antenna may become bent, or broken completely, reducing its effectiveness. Therefore, the use of a whip antenna (similar to those seen used with wireless routers and radios) on a protocol adapter is often considered undesirable.

Accordingly, there exists a need for an improved type of antenna for a device which is exposed to environments which have the potential to cause damage to the antenna.

SUMMARY OF THE INVENTION

The present invention is an endplate formed as part of a device used for transmitting or receiving a signal. The endplate has an inner plate, an outer plate operable for being connected to the inner plate, and an antenna mounted to the inner plate. The antenna is operable for connection with a device, such as a protocol adapter, which transmits and receives a signal. The endplate is operable for providing a ground plane relationship between the endplate and the antenna. The ground plane relationship between the endplate and the antenna is accomplished through the use of one of either the inner plate our outer plate being made of metal.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
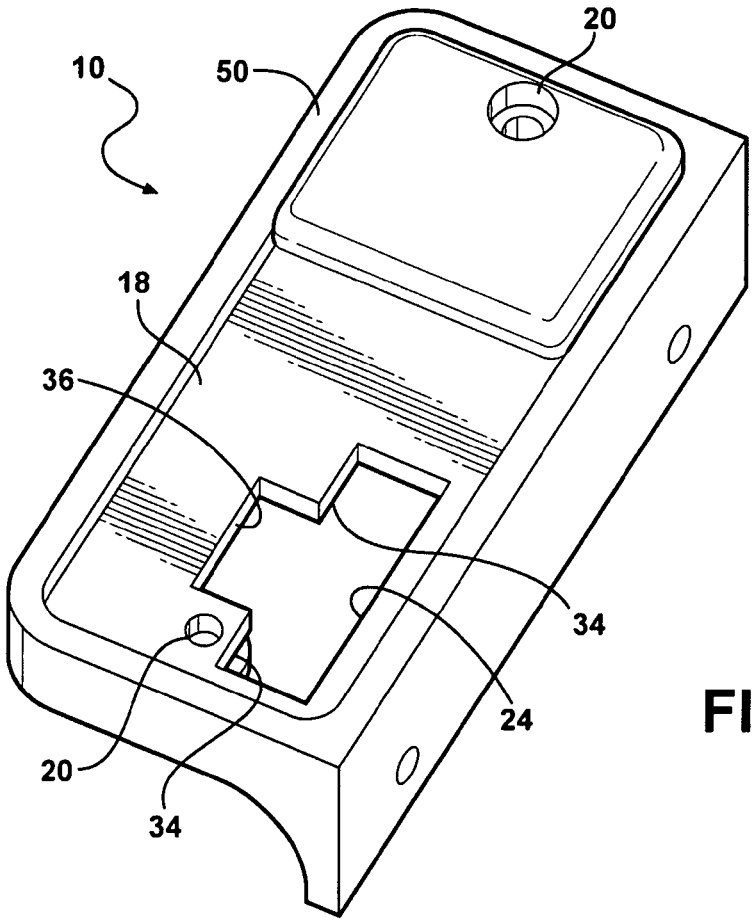
FIG. 1 is a perspective view of an endplate used for mounting an antenna, according to the present invention.

The following description of the preferred embodiment(s) is merely exemplary in nature and is in no way intended to limit the invention, its application, or uses.

Referring to the Figures generally, an endplate for a communications device upon which an antenna is mounted according to the present invention is shown generally at 10. The endplate 10 is connected to a device 12 which is operable for providing communications between a computer and the electronic control unit (ECU) of a motor vehicle. In this embodiment, the device 12 is a protocol adapter, but it is within the scope of the invention that the endplate 10 and an antenna 14 may be used with other devices that require the use of an RF antenna as well, such as short wave radios, wireless routers, AM/FM radios, and the like.

The endplate 10 includes an inner plate 16 and an outer plate 18. The outer plate 18 has a pair of apertures 20 which are operable for receiving a set of fasteners 22, which may be screws or the like. The outer plate 18 also includes a substantially "T-shaped" aperture 24 which is suitable for receiving a connector, shown generally at 26, such as a Universal Serial Bus (USB) connector 26 having a positive locking mechanism, such as the USB connector described in commonly owned application Ser. No. 12/218,706, the entire specification of which is herein incorporated by reference. The USB connector 26 has two mounting blocks 28, each of which includes an aperture 30 suitable for receiving a fastener (not shown), and a central portion 32. When the USB connector 26 is inserted through the T-shaped aperture 24, the mounting blocks 28 extend through respective wing portions 34 of the T-shaped aperture 24, and the central portion 32 of the USB connector 26 extends through a central portion 36 of the T-shaped aperture 24.

The inner plate 16 includes a substantially square shaped aperture 38, and a set of attachment mechanisms 40 in proximity to the square-shaped aperture 38. Each of the attachment mechanisms 40 includes an inner threaded portion 42 and an outer threaded portion 44, the outer threaded portion 44 being similar to a bolt. Each of the outer threaded portions 44 extend through a set of apertures (not shown) on the inner plate 16, and a nut 46. The nut 46 is screwed onto the outer threaded portion 44 of the attachment mechanism 40, securing the attachment mechanism 40 to the inner plate 16.

There is also another set of apertures 48 formed as part of the inner plate 16 which are in alignment with the apertures 20 on the outer plate 18. There is also a bumper 50 which surrounds both the inner plate 16 and outer plate 18. The bumper 50 also has apertures 52 which extend through a set of loops 54 formed as part of the bumper 50. When assembled, the apertures 52 of the bumper 50 are aligned with the apertures 20 of the outer plate 18 and the apertures 48 formed on the inner plate 16, and are also in alignment with a set of apertures 56 formed as part of the protocol adapter 12. The screws 22 are inserted through the apertures 20 of the outer plate 18, the apertures 52 of the bumper 50, the apertures 48 of the inner plate 16, and the apertures 56 of the protocol adapter 12 to connect the end plate 10 to the protocol adapter 12.

The antenna 14 is located adjacent to the inner plate 16 through the use of a connection 58, such as soldering or the like, to a "lead wire" 60. The inner plate 16 and outer plate 18 are shaped such that when the inner plate 16 and outer plate 18 are connected together, there is a cavity, shown generally at 62, in which the antenna 14 is located. The antenna 14 is made of copper, or any other material suitable for transmitting a signal, and includes a coil portion generally shown at 64 and an elongated portion 66. Also included is a support pad 68 which is made of a foam or other material suitable for supporting the coil portion 64 as shown in the Figures. There is an adhesive (not shown) which attaches the support pad 68 to the inner plate 16.

Figure 2:
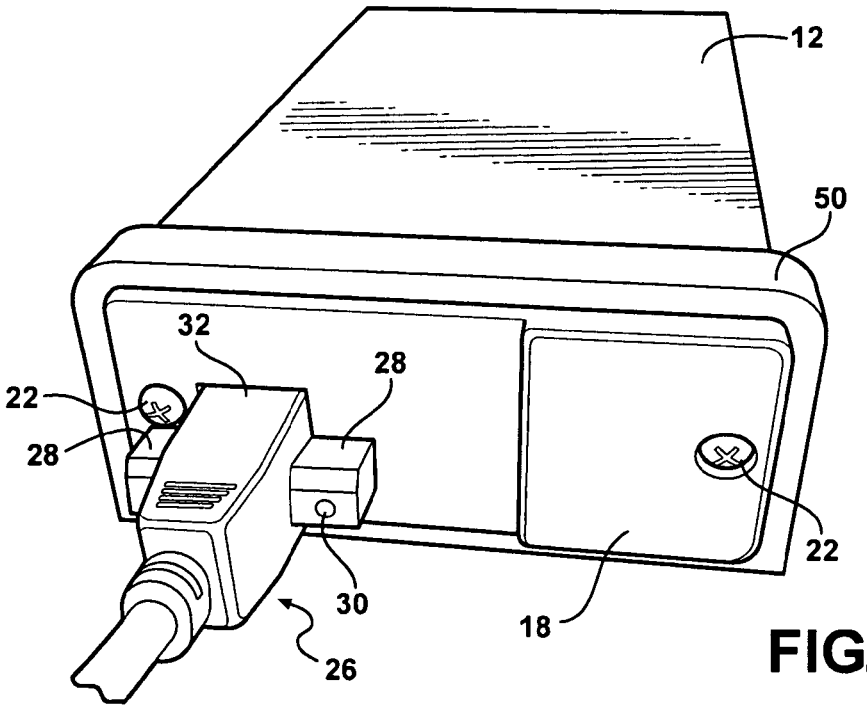
FIG. 2 is a perspective rear view of an endplate connected to a protocol adapter, with a connector extending through the endplate into the protocol adapter, according to the present invention.
Figure 3:
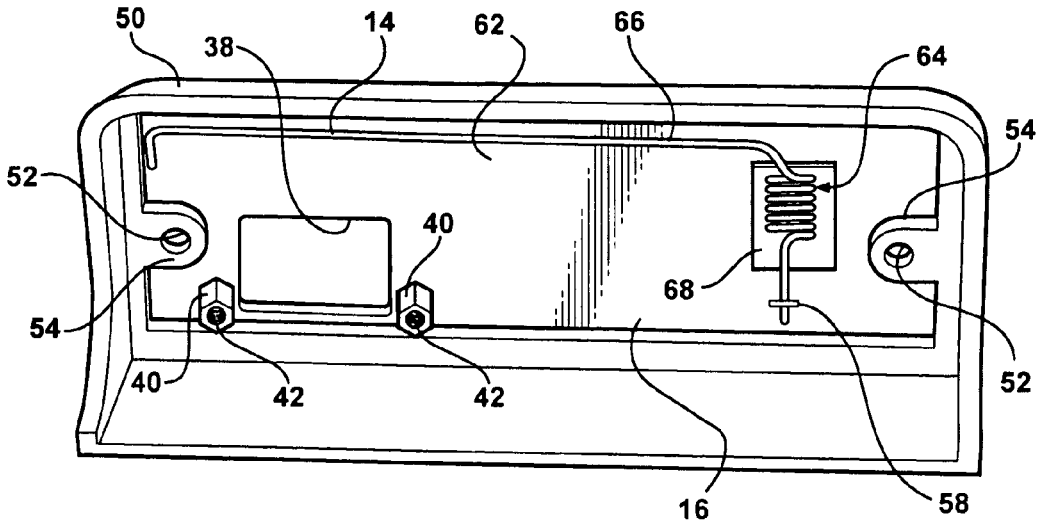
FIG. 3 is a front view of an endplate used for mounting an antenna, according to the present invention.
Figure 4:
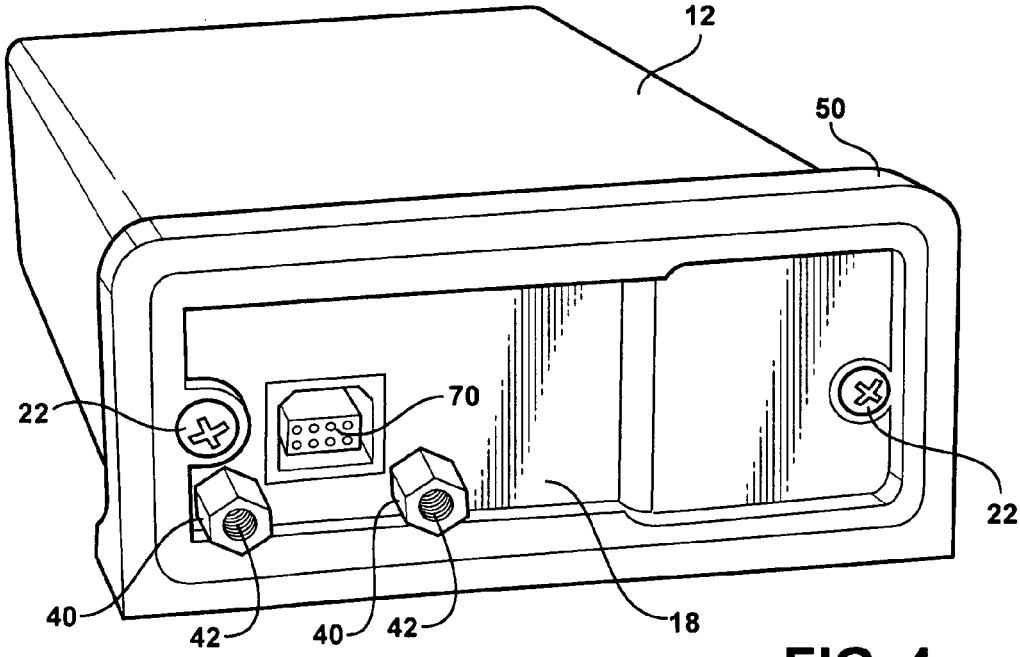
FIG. 4 is a front view of an endplate attached to a protocol adapter, according to the present invention.
Figure 5:
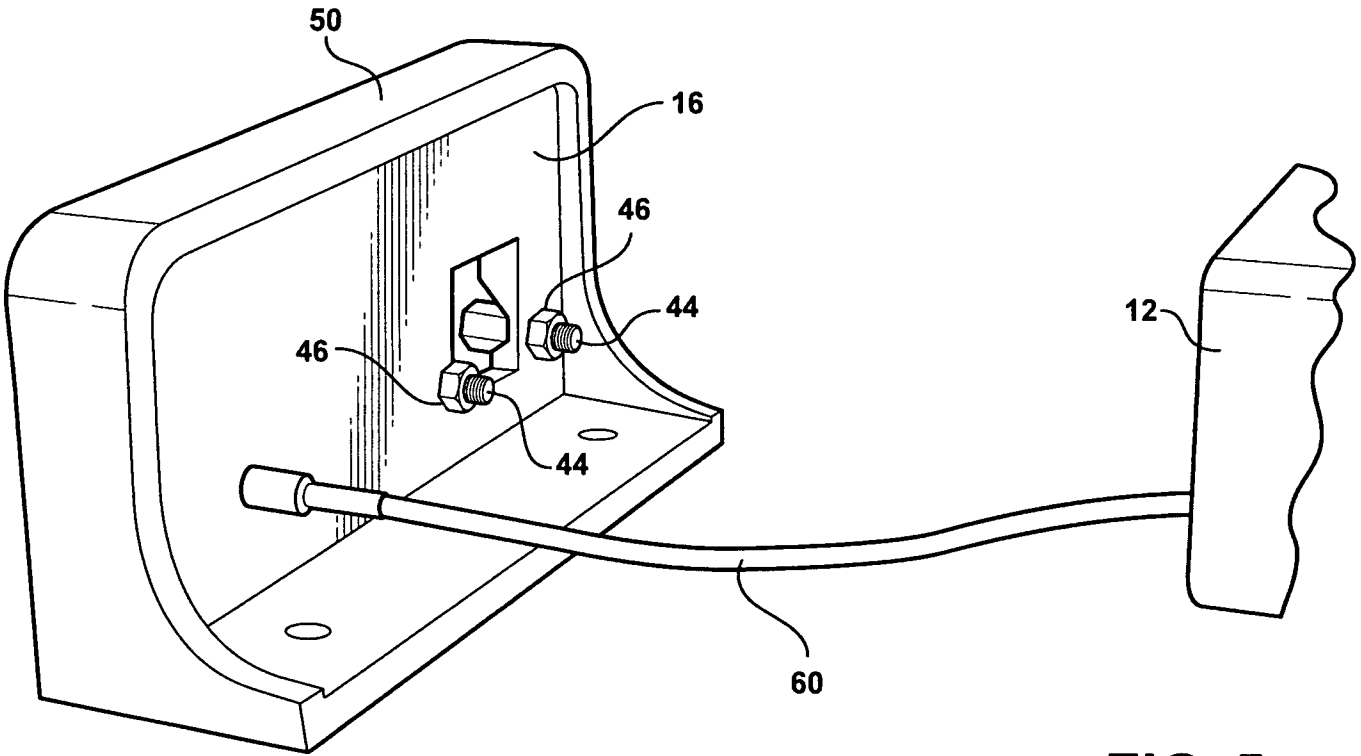
FIG. 5 is a rear perspective view of an endplate used for mounting an antenna, according to the present invention.
Figure 6:
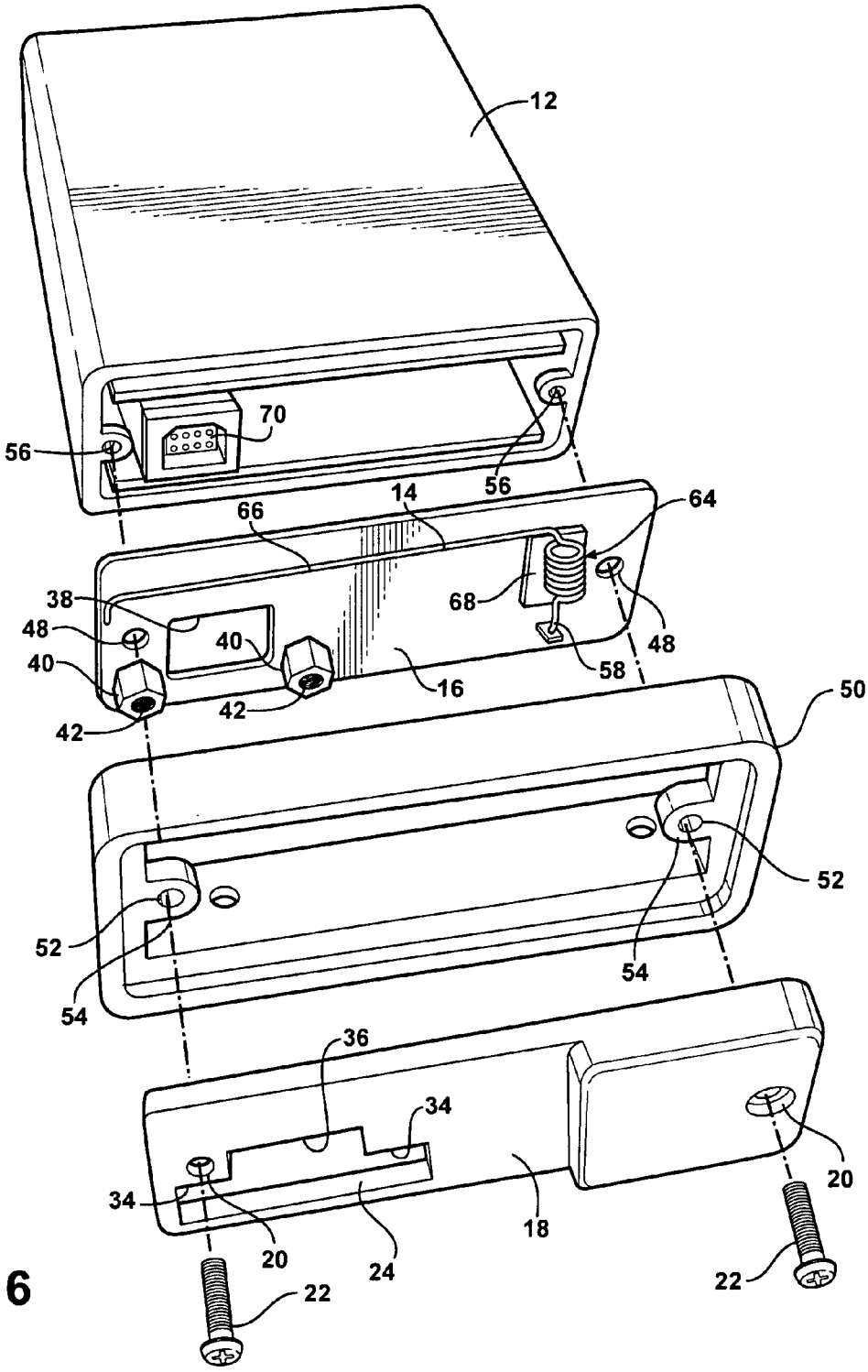
FIG. 6 is an exploded view of a protocol adapter using an endplate, according to the present invention.

As discussed above, there is a square-shaped aperture 38 which is formed as part of the inner plate 16. This square-shaped aperture 38 is aligned with a corresponding connector 70 which is operable for connection with the central portion 32 of the USB connector 26. During assembly, the outer plate 18 is placed adjacent the inner plate 16 (with the bumper 50 at least partially disposed between and surrounding the inner plate 16 and outer plate 18 as shown in the Figures) such that the apertures 48 of the inner plate 16 are placed in alignment with the apertures 52 of the bumper 50 and the apertures 20 of the outer plate 18. The fasteners 22 are then inserted through the apertures 20,48,52 and into the apertures 56 of the device 12, thereby securing the inner plate 16 to the outer plate 18, and securing the entire endplate 10 to the device 12. The USB connector 26 is then inserted into the corresponding connector 70 as shown in FIG. 2; the mounting blocks 28 extend through respective wing portions 34 of the T-shaped aperture 24, and the central portion 32 of the USB connector 26 extends through a central portion 36 of the T-shaped aperture 24 into the corresponding connector 70. The set of fasteners (not shown) are then inserted through the apertures 30 formed in the mounting blocks 28 and into the inner threaded portion 42 of the attachment mechanisms 40, thereby securing the USB connector 26 to the device 12.

When the antenna 14 is mounted to the inner plate 16 of the endplate 10, the connection to the lead wire 60 is rigid enough so as to hold the antenna 14 in place in the cavity 62 of the end plate 10. Because the antenna 14 is soldered directly to the lead wire 60 of the device 12, the connector typically used to connect the antenna to the lead wire is eliminated.

The endplate 10 is also functional, the endplate 10 serves to provide a "ground plane" relationship between the endplate 10 and the antenna 14. A ground plane structure or relationship exists between an antenna and another object, where the only structure of the object is a structure which permits the antenna to function as such (e.g., forms a reflector or director for an antenna). In a typical RF antenna, one end of the antenna is attached to a metalized part or connector to form a ground plane. In the present invention, the metalized part is removed. In order for there to be a ground plane relationship between the endplate 10 and the antenna 14, the endplate 10 must be made of metal. Using a type of plastic or other material will not allow the antenna 14 to have a maximum range. The device of the present invention is operable to have approximately two-hundred feet of range, but it is within the scope of the invention that other types of endplates 10 may be used with a different type of antenna 14 to increase or decrease the range.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. An endplate formed as part of a device used for transmitting or receiving a signal, comprising:

an inner plate;

an outer plate operable for being connected to said inner plate;

an antenna mounted to said inner plate, said antenna being operable for connection with a device which transmits and receives a signal, wherein said endplate is operable for providing a ground plane relationship between said endplate and said antenna; and a cavity formed between said inner plate and said outer plate when said inner plate is connected to said outer plate, said antenna being disposed in said cavity.

2. The endplate formed as part of a device used for transmitting or receiving a signal of claim 1, further comprising:

at least one aperture formed as part of said inner plate;

at least one aperture formed as part of said outer plate; and at least one fastener operable for being inserted through said at least one aperture formed as part of said inner plate and said at least one aperture formed as part of said outer plate, said at least one fastener operable for extending into said device, connecting said inner plate to said outer plate, and connecting said end plate to said device.

3. The endplate formed as part of a device used for transmitting or receiving a signal of claim 1, wherein said device is operable to be connected to said antenna, and said antenna serves to increase a signal being transmitted and received by said device.

4. The endplate formed as part of a device used for transmitting or receiving a signal of claim 3, further comprising a lead wire, said lead wire being operable for connecting said device to at least one end of said antenna.

5. The endplate formed as part of a device used for transmitting or receiving a signal of claim 4, wherein said lead wire is soldered to at least one end of said antenna.

6. The endplate formed as part of a device used for transmitting or receiving a signal of claim 1, said antenna further comprising:

an elongated portion; and a coil portion connected to said elongated portion, wherein said coil portion and said elongated portion are operable with said endplate for allowing said device to transmit and receive a signal.

7. The endplate formed as part of a device used for transmitting or receiving a signal of claim 6, further comprising a support pad mounted onto said inner plate, said support pad being operable for supporting said coil portion of said antenna.

8. The endplate formed as part of a device used for transmitting or receiving a signal of claim 1, further comprising one of said inner plate or said outer plate being made of a material allowing said inner plate or said outer plate to provide said ground plane relationship between said antenna and one or both of said inner plate and said outer plate.

9. The endplate formed as part of a device used for transmitting or receiving a signal of claim 8, further comprising one of said inner plate or said outer plate being made of metal to provide said ground plane relationship between said antenna and one or both of said inner plate and said outer plate.

10. The endplate formed as part of a device used for transmitting or receiving a signal of claim 1, further comprising a bumper surrounding said inner plate and said outer plate when said inner plate is connected to said outer plate.

11. An endplate formed as part of a device used for transmitting or receiving a signal, comprising:

an inner plate;

an outer plate operable for being connected to said inner plate;

an antenna mounted to said inner plate, said antenna being operable for connection with a device which transmits and receives a signal, wherein said endplate is operable for providing a ground plane relationship between said endplate and said antenna to increase a signal being transmitted and received by said device;

at least one aperture formed as part of said inner plate;

at least one aperture formed as part of said outer plate; and at least one fastener operable for being inserted through said at least one aperture formed as part of said inner plate and said at least one aperture formed as part of said outer plate, said at least one fastener operable for extending into said device, thereby connecting said inner plate to said outer plate, and connecting said end plate to said device, wherein a cavity is formed between said inner plate and said outer plate when said inner plate is connected to said outer plate, said antenna being disposed within said cavity.

12. The endplate formed as part of a device used for transmitting or receiving a signal of claim 11, further comprising a lead wire connected to said device, wherein at least one end of said antenna is connected to said lead wire.

13. The endplate formed as part of a device used for transmitting or receiving a signal of claim 12, wherein said lead wire connected to said device is connected to said at least one end of said antenna through a solder connection.

14. The endplate formed as part of a device used for transmitting or receiving a signal of claim 11, said antenna further comprising:

a coil portion; and an elongated portion connected to said coil portion, wherein said coil portion and said elongated portion are operable with said endplate for transmitting and receiving a signal from said device.

15. The endplate formed as part of a device used for transmitting or receiving a signal of claim 14, further comprising a support pad mounted onto said inner plate, said support pad being operable for supporting said coil portion of said antenna.

16. The endplate formed as part of a device used for transmitting or receiving a signal of claim 11, further comprising one of said inner plate and said outer plate being made of metal, thereby providing said ground plane relationship between said antenna and one or both of said inner plate and said outer plate.

17. The endplate formed as part of a device used for transmitting or receiving a signal of claim 11, further comprising a bumper surrounding said inner plate and said outer plate when said inner plate is connected to said outer plate.

18. An endplate operable for connection with a protocol adapter, the protocol adapter being operable for transmitting or receiving a signal through an antenna, comprising:

an inner plate;

at least one aperture formed as part of said inner plate;

an outer plate;

at least one aperture formed as part of said outer plate;

at least one fastener operable for being inserted through said at least one aperture formed as part of said inner plate and said at least one aperture formed as part of said outer plate, said at least one fastener operable for extending into a protocol adapter, thereby forming a cavity between said inner plate and said outer plate, and connecting said end plate to said protocol adapter; and an antenna disposed within said cavity formed by said inner plate and said outer plate, said antenna being operable for connection with said protocol adapter, wherein said endplate is operable for providing a ground plane relationship between said endplate and said antenna.

19. The endplate formed as part of a protocol adapter used for transmitting or receiving a signal of claim 18, wherein said protocol adapter is operable to be connected to said antenna for transmitting and receiving a signal.

20. The endplate formed as part of a protocol adapter used for transmitting or receiving a signal of claim 19, further comprising a lead wire connected to said protocol adapter, wherein at least one end of said antenna is soldered to said lead wire.

21. The endplate formed as part of a protocol adapter used for transmitting or receiving a signal of claim 18, said further comprising:

a coil portion formed as part of said antenna;

an elongated portion formed as part of said antenna, said elongated portion being connected to said coil portion, wherein said coil portion and said elongated portion are operable with said endplate for allowing said protocol adapter to transmit and receive a signal; and a support pad mounted onto said inner plate, said support pad being operable for supporting said coil portion of said antenna.

22. The endplate formed as part of a protocol adapter used for transmitting or receiving a signal of claim 18, wherein said cavity formed between said inner plate and said outer plate when said inner plate is connected to said outer plate.

23. The endplate formed as part of a protocol adapter used for transmitting or receiving a signal of claim 18, further comprising a one of said inner plate and said outer plate being made of metal, thereby providing a ground plane relationship between said antenna and one or both of said inner plate and said outer plate.

24. The endplate formed as part of a device used for transmitting or receiving a signal of claim 18, further comprising a bumper surrounding said inner plate and said outer plate when said inner plate is connected to said outer plate.

* * * * *